United States Patent [19]

Russell

[11] Patent Number: 4,819,336

[45] Date of Patent: Apr. 11, 1989

[54] METHOD OF DETERMINING THE ORIENTATION OF A SURVEYING INSTRUMENT IN A BOREHOLE

[75] Inventor: Anthony W. Russell, Turriff, Scotland

[73] Assignee: NL Sperry-Sun, Inc., Houston, Tex.

[21] Appl. No.: 4,954

[22] Filed: Jan. 20, 1987

[30] Foreign Application Priority Data

Jan. 22, 1986 [GB] United Kingdom ..... 8605123

[51] Int. Cl.[4] ..... E21B 47/022

[52] U.S. Cl. ..... 33/304; 33/313

[58] Field of Search ..... 33/313, 312, 302, 304

[56] References Cited

U.S. PATENT DOCUMENTS

| | | | |
|---|---|---|---|
| 3,935,642 | 2/1976 | Russell | 33/302 |
| 4,163,324 | 8/1979 | Russell et al. | 33/313 |
| 4,510,696 | 4/1985 | Roesler | 33/313 |

FOREIGN PATENT DOCUMENTS

| | | |
|---|---|---|
| 1578053 | 2/1977 | United Kingdom . |
| 2158587 | 11/1985 | United Kingdom . |

*Primary Examiner*—William D. Martin, Jr.
*Attorney, Agent, or Firm*—Browning, Bushman, Zamecki & Anderson

[57] ABSTRACT

For the purposes of determining the orientation of a surveying instrument in a borehole, while compensating for the effects of perturbing magnetic fields associated with magnetized sections of the drill string both above and below the instrument, the inclination angle $\theta$ and the highside angle $\phi$ of the instrument are determined, together with two transverse components Bx and By of the local magnetic field as measured at the instrument in the borehole. Additionally either a single component of, or the magnetide of, the true earth's magnetic field at the location of the borehole is ascertained from a look-up table or directly by measurement away from the influence of the drill string. A value $\Psi a$ for the azimuth angle of the instrument is then determined from the inclination and highside angles, the measured component(s) of the local magnetic field, and only the single component of, or the magnitude of, the true earth's magnetic field.

3 Claims, 3 Drawing Sheets

METHOD OF DETERMINING THE ORIENTATION OF A SURVEYING INSTRUMENT IN A BOREHOLE

This invention relates to the surveying of boreholes, and more particularly to methods of, and apparatus for, determining the orientation of a surveying instrument in a borehole.

It is well known to survey boreholes which are not cased with a steel lining by making measurements down-hole using two or three mutually orthogonal fluxgates and two or three mutually orthogonal accelerometers disposed in a non-magnetic drill collar, so as to determine a series of parameters, such as the inclination angle and the azimuth angle, indicative of the directivity at locations along the borehole. However, the determination of the azimuth angle is based on measurements of the earth's magnetic field made by the fluxgates and these are rendered inaccurate by the presence of perturbing magnetic fields associated with magnetised sections of the drill string both above and below the measuring instrument. One solution to this problem is to dispose the instrument in a drill collar or a series of drill collars made of non-magnetic material extending for some distance both above and below the measuring location. However, the provision of such non-magnetic drill collars is costly.

U.K. Specification No. 1,578,053 describes a method enabling a survey to be conducted using a measuring instrument disposed in only a relatively short non-magnetic drill collar in which a correction is applied to the measured azimuth angle to compensate for the effect of the perturbing magnetic fields. This correction is determined as a function of the horizontal and vertical components of the earth's magnetic field, as ascertained from look-up tables for example, the local magnetic field, as measured by the instrument, and measured values of the inclination angle and the azimuth angle relative to the apparent magnetic North direction at the location of the instrument. Two possible expressions are described for calculation of the azimuth correction, but both these expressions suffer from disadvantages in terms of errors inherent in their reduction to practice under certain conditions.

U.K. Specification No. 2,158,587A describes a method of determining a correction to be made to the azimuth angle to compensate for the magnetic interference in which the correction is determined from the difference between a measured dip angle and the true dip angle of the earth's magnetic field, the absolute value of the true dip angle and the measured values of the inclination angle and the azimuth angle relative to the apparent magnetic North direction at the location of the instrument. This method effectively corresponds to the method of U.K. Specification No. 1,578,053, except that the expression which is actually used for calculation of the azimuth correction is based on the quite unwarranted assumption that this azimuth correction will at all times be small, with the result that the method would be highly inaccurate in practice under certain conditions.

The present invention has as its object the determination of the absolute azimuth angle using a measuring instrument disposed in a relatively short non-magnetic drill collar in such a manner as to minimise the errors inherent in calculation of this angle and to simplify the calculation.

According to the invention, there is provided a method of determining the orientation of a surveying instrument in a borehole, which method comprises:

(a) determining the inclination angle $\theta$ of the instrument in the borehole;

(b) determining the highside angle $\theta$ of the instrument in the borehole;

(c) determining at least one component of the local magnetic field as measured at the instrument in the borehole;

(d) ascertaining either a single component of, or the magnitude of, the true earth's magnetic field at the location of the borehole; and (e) determining a value $\Psi a$ for the azimuth angle of the instrument in the borehole from the inclination and highside angles, the measured component(s) of the local magnetic field, and only the single component of, or the magnitude of, the true earth's magnetic field.

Preferably said determination of at least one component of the local magnetic field as measured at the instrument comprises determining two transverse components Bx and By of the local magnetic field perpendicular to the longitudinal axis of the instrument in the borehole.

In order that the invention may be more fully understood, reference will now be made, by way of example, to the accompanying drawings, in which.

Figure 1:
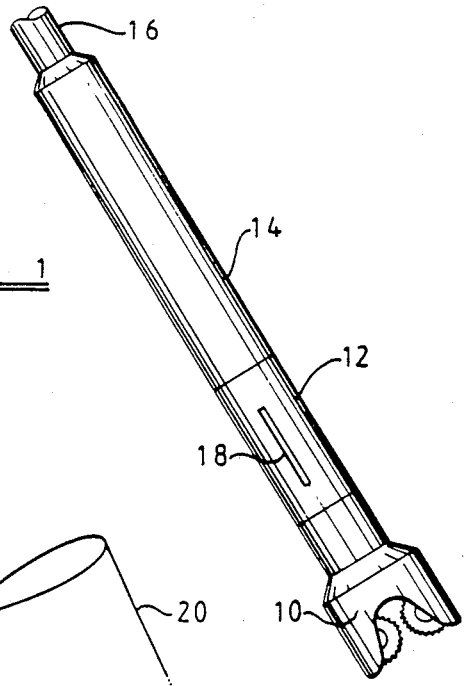
FIG. 1 is a schematic view of a drill string incorporating a survey instrument for carrying out the method in accordance with the invention.

Referring to FIG. 1, a drill string comprises a drilling bit 10 which is coupled by a non-magnetic drill collar 12 and a set of drill collars 14, which may be made of magnetic material, to a drill pipe 16. The non-magnetic drill collar 12 contains a survey instrument 18 in accordance with the invention. The instrument 18 comprises three accelerometers arranged to sense components of gravity in three mutually orthogonal directions, one of which is coincident with the longitudinal axis of the drill string, three fluxgates arranged to measure magnetic field strength in the same three mutually orthogonal directions and associated signal processing apparatus, as will be described hereinafter with reference to FIG. 6.

Figure 2:
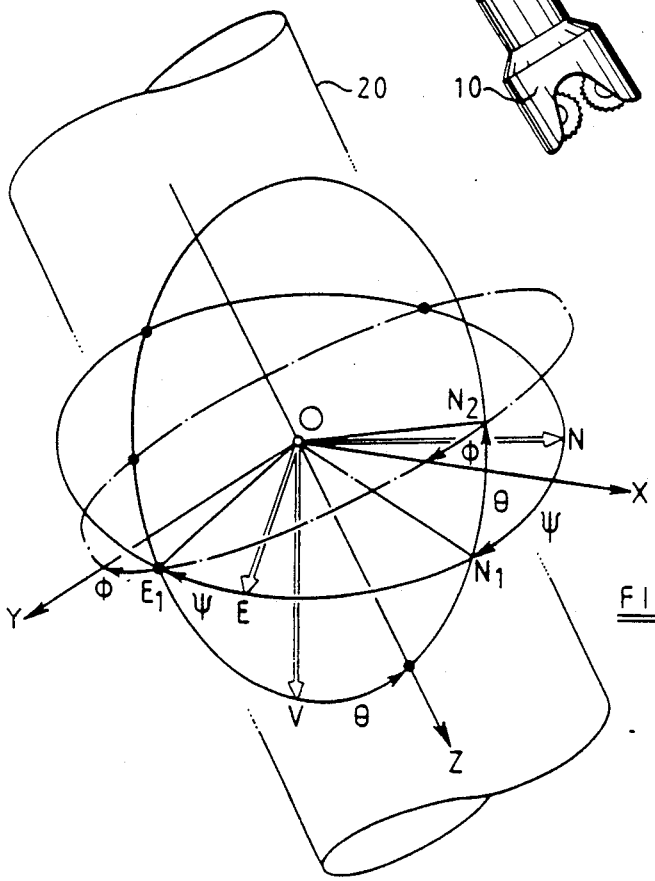
FIG. 2 is a diagram illustrating transformations between the earth-fixed frame and the instrument-fixed frame.

FIG. 2 shows a borehole 20 schematically and illustrates various reference axes relative to which the orientation of the borehole 20 may be defined. A set of earth-fixed axes (ON, OE and OV) are illustrated with OV being vertically down and ON being a horizontal reference direction. A correspondingly instrument-case-fixed set of axes OX, OY and OZ are illustrated where OZ is the longitudinal axis of the borehole (and therefore of the instrument case) and OX and OY, which are in a plane perpendicular to the borehole axis represented by a chain-dotted line, are the other two above-mentioned directions in which the accelerometers and fluxgates are orientated.

A spatial survey of the path of a borehole is usually derived from a series of measurements of an azimuth angle $\Psi$ and an inclination angle $\theta$. Measurements of ($\Psi$, $\theta$) are made at successive stations along the path and the distances between these stations are accurately known. The set of instrument-fixed orthogonal axes OX, OY and OZ are related to the earth-fixed set of axes ON, OE and OV through a set of angular rotations ($\Psi$, $\theta$, $\phi$), where $\phi$ is the highside angle.

The relationships between the vector components of the gravity vector $$\bar{g}=g.\overline{Uv}=gx.\overline{Ux}+gy.\overline{Uy}+gz.\overline{Uz}$$

and the magnetic field vector $$\bar{B}=Bn.\overline{Un}+Bv.\overline{Uv}=Bx.\overline{Ux}+By.\overline{Uy}+Bx.\overline{Uz}$$

in terms of the surveying angles are developed and listed in Appendix A. ($\overline{U}$ denotes Unit Vector)

Figure 6:
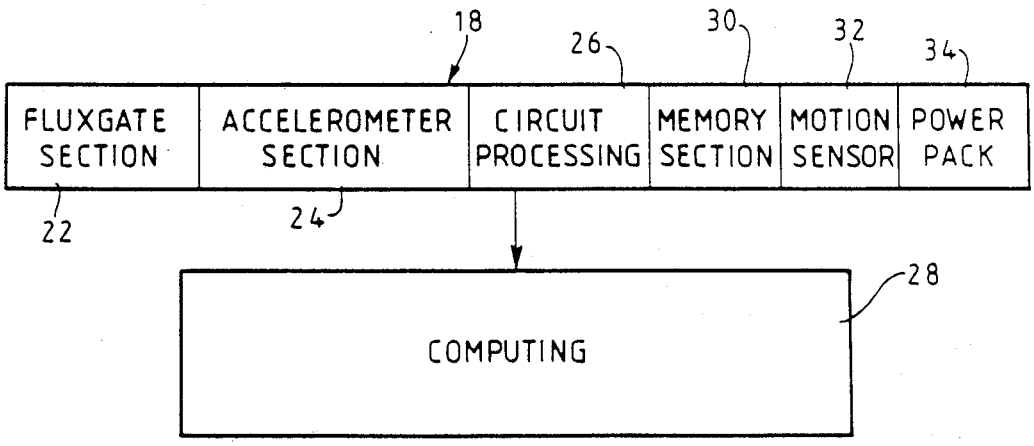
FIG. 6 is a block schematic diagram of the instrument of FIG. 1.

As shown in FIG. 6, the survey instrument 18 comprises a fluxgate section 22 and an accelerometer section 24. The outputs from the three mutually orthogonal fluxgates comprise the components B, $B_y$ and $B_z$ of the local magnetic field along the axes OX, OY and OZ, respectively. Similarly, the outputs from the three accelerometers in the accelerometer section 24 comprise the components $g_x$, $g_y$ and $g_z$ of the local gravitational field along the axes OX, OY and OZ. These six outputs are in the form of proportional voltages which are applied to a circuit processing unit 26 comprises analogue to digital converters. The outputs from the analogue to digital converters in the circuit processing unit 26 are ultimately processed through a digital computing unit 28 to yield values of the azimuth $\Psi$ and inclination $\theta$. This computing operation may be performed within the survey instrument and the computed values stored in a memory section 30 which preferably comprises one or more solid-state memory packages. However, instead of storing the two computed values $\Psi$ and $\theta$, it will usually be more convenient to provide the memory section 30 with sufficient capacity to store all six outputs from the analogue to digital converters in the circuit processing unit 26 and to provide the computing unit 28 in the form of a separate piece of apparatus to which the survey instrument is connected after extraction from the borehole for performing the computing operation. The instrument 18 also comprises a motion sensor 32 arranged to detect motion of the instrument within the earth's reference frame so that survey measurements are made only when the instrument is stationary within that frame. Power for the instrument is supplied by a battery power pack 34.

The measurement of azimuth in long non-magnetic drill collars where $\bar{B}$ is considered to be the earth's magnetic field vector $\overline{Be}$ can be represented by an operation equation relating the input and output sets as follows:

$$\{Bx',By',Bz,\theta\}\rightarrow\{\Psi, Bev,Ben\}$$

where $Bx' = Bx \cdot \cos\phi - By \cdot \sin\phi$ and $By' = Bx \cdot \sin\phi + By \cdot \cos\phi$ The measurement of absolute azimuth (with respect to the earth's magnetic field horizontal component direction) in situations where the value of Bez is corrupted by the effect of the drill string and/or the bottomhole assembly can be represented by an operation equation relating the input and output sets as follows:

$$\{Bx',By',\{Be\},\theta\}\rightarrow\{\Psi a,Bez\}$$

where {Be} is a sub-set of the input set consisting of known parameters of the earth's magnetic field $\overline{Be}$ with a specific form determined by the method (operation) used to calculate $\Psi$a.

From the transformation equations set out in Appendix A, if the local magnetic field as measured by the fluxgate section 22 is $\bar{B}=Bex.\overline{Ux}+Bey.\overline{Uy}+Bez.\overline{Uz}+E.\overline{Uz}$, where E is the magnetic field due to the drill string and/or bottomhole assembly, $$Bex' = Bex \cdot \cos\phi - Bey \cdot \sin\phi \quad \text{and}$$
$$Bey' = Bex \cdot \sin\phi + Bey \cdot \cos\phi$$

then, if $\Psi$a is the absolute azimuth angle, $$Bex' = Ben \cdot \cos\psi a \cdot \cos\theta - Bev \cdot \sin\theta \quad (1)$$
$$Bey' = -Ben \cdot \sin\psi a \quad (2)$$
$$Bez = Ben \cdot \cos\psi a \cdot \sin\theta + Bev \cdot \cos\theta \quad (3)$$

Equations (1) and (2) yield:

$$\frac{\sin\psi a}{\cos\psi a} = \frac{-Bey'}{(Bex' + Bev \cdot \sin\theta)/\cos\theta} \quad (4)$$

and equations (1), (2) and (3) yield:

$$\frac{\sin\psi a}{\cos\psi a} = \frac{-Bey'}{Bex' \cdot \cos\theta + Bez \cdot \sin\theta} \quad (5)$$

Equations (1) and (2) also yield:

$$Ben = \{Bey'^2 + \{(Bex' + Bev \cdot \sin\theta)/\cos\theta\}^2\}^{\frac{1}{2}} \quad (6)$$

The measured components of $\bar{B}$ in this case can be written:

$$Bx=Bex;\ By=Bey;\ Bz=Bez+E$$

In the case where a sufficiently long non-magnetic drill collar is used, it can be assumed that Bz=Bez and the absolute azimuth angle can be calculated from equation (5):

$$\frac{\sin\psi a}{\cos\psi a} = \frac{-By'}{Bx' \cdot \cos\theta + Bz \cdot \sin\theta} \quad (6a)$$

In the case of significant corruption of the earth's magnetic field by the drill string and bottomhole assembly various methods can be used to determine the absolute azimuth angle, and several of these are discussed briefly below:

(i) {Be}=Bev

If the value of the earth's magnetic field vertical component Bev is known, then the absolute azimuth angle can be calculated directly from equation (4):

$$\frac{\sin\psi a}{\cos\psi a} = \frac{-By'}{\{(Bx' + Bev \cdot \sin\theta)/\cos\theta\}} \tag{7}$$

(ii) {Be}=Be, Sign of Bez

If the value of the magnitude of the earth's magnetic field Be is known together with some knowledge of the sign of the component Bez of the earth's magnetic field, then $$Bez = \{Be^2 - Bx'^2 - By'^2\}^{\frac{1}{2}}$$

can be substituted for Bz in equation (6a) above to yield the absolute azimuth angle. If Bn is calculated from equation (6) as:

$$Bn = \{By'^2 + \{(Bev \cdot \sin\theta)/\cos\theta\}^2\}^{\frac{1}{2}} \tag{8}$$

then the difference Ben-Bn can be used to determine the possible presence of corruption of the Bex and Bey magnetic field components (if significant after consideration of possible instrument and earth's magnetic field errors).

In a preferred implementation the absolute azimuth angle Ψa is measured using the instrument of FIGS. 1 and 6 by determining the inclination angle $\theta$ and the highside angle $\phi$ from the measured gravity components using equations (38) and (39) of Appendix A, and using these values, the measured components Bx and By of the local magnetic field and the known vertical component Bev of the true earth's magnetic field in equation (7) to compute a value for the absolute azimuth angle. The component Bev of the true earth's magnetic field may be obtained from a look-up table, but is preferably directly measured by the measuring instrument under conditions where the earth's magnetic field is not perturbed by the presence of the drill string and/or bottomhole assembly.

The measurement error associated with this calculation method will increase as the inclination angle $\theta$ increases, so that, for high inclination angles close to 90° (above 70° or more), it is preferred to determine the absolute azimuth angle Ψa simply from equation (2), that is:

$$\sin\psi a = -\frac{By'}{Ben}$$

(although a knowledge of the actual quadrant of Ψa must be obtained in this case from other considerations).

In the ideal case with zero instrument measurement errors and zero error in the values of the earth's magnetic field parameters used in the calculations, all methods of determining the correcting azimuth angle, including the prior art methods referred to above, will yield the theoretically correct result for the absolute azimuth. However, it should be appreciated that the error in the absolute azimuth obtained in practice is highly dependent on the calculation method(s) chosen, and it is the understanding of the error patterns themselves which determine which method(s) should be used to produce the best results.

APPENDIX A

Figure 3A:
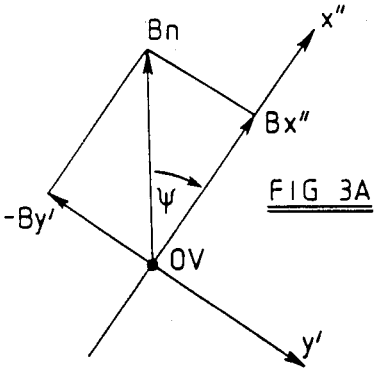
FIGS. 3A to 3C are diagrams illustrating transformation of the magnetic field components from the earth-fixed frame to the instrument-fixed frame.

1. Translation from $\begin{bmatrix} Bn \\ 0 \\ Bv \end{bmatrix}$ to $\begin{bmatrix} Bx \\ By \\ Bz \end{bmatrix}$ via the operators $\{\psi\}\ \{\theta\}\ \{\phi\}$ From FIG. 3A $$Bx'' = Bn \cdot \cos\psi \tag{11}$$
$$By' = -Bn \cdot \sin\psi \tag{12}$$

Figure 3B:
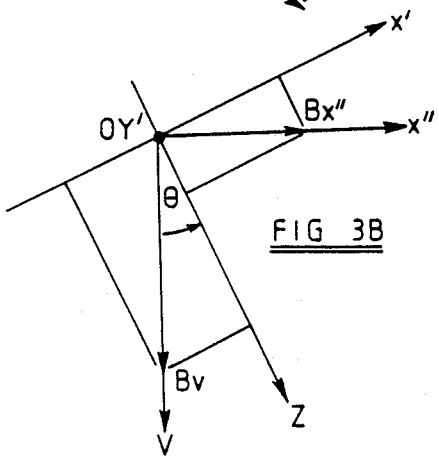

From FIG. 3B $$Bx' = Bx'' \cdot \cos\theta - Bv \cdot \sin\theta \tag{13}$$
$$Bz = Bx'' \cdot \sin\theta + Bv \cdot \cos\theta \tag{14}$$

Figure 3C:
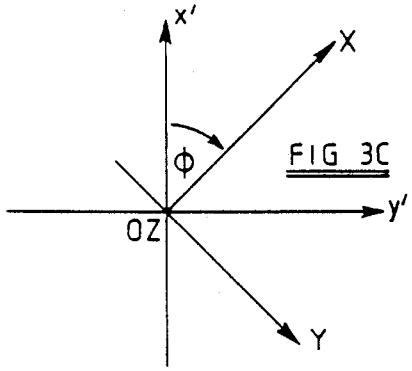

From FIG. 3C $$Bx = Bx' \cdot \cos\phi + By' \cdot \sin\phi \tag{15}$$
$$By = -Bx'\sin\phi + By' \cdot \cos\phi \tag{16}$$

Thus, from equations (11) to (16):

$$Bx = (Bn \cdot \cos\psi \cdot \cos\theta - Bv \cdot \sin\theta) \cdot \cos\phi - Bn \cdot \sin\psi \cdot \sin\phi \tag{17}$$

$$By = -(Bn \cdot \cos\psi \cdot \cos\theta - Bv \cdot \sin\theta) \cdot \sin\phi - Bn \cdot \sin\psi \cdot \cos\phi \tag{18}$$

$$Bz = Bn \cdot \cos\psi \cdot \sin\theta + Bv \cdot \cos\theta \tag{19}$$
$$Bx' = Bn \cdot \cos\psi \cdot \cos\theta - Bv \cdot \sin\theta \tag{20}$$
$$By' = -Bn \cdot \sin\theta \tag{21}$$

Figure 4A:
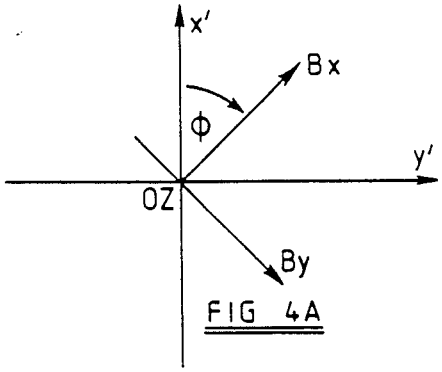
FIGS. 4A to 4C are diagrams illustrating transformation of the magnetic field components from the instrument-fixed frame to the earth-fixed frame.

2. Translation from $\begin{bmatrix} Bx \\ By \\ Bz \end{bmatrix}$ to $\begin{bmatrix} Bn \\ 0 \\ Bv \end{bmatrix}$ via operators $\{\phi\}^T\ \{\theta\}^T\ \{\psi\}^T$ From FIG. 4A $$Bx' = Bx \cdot \cos\phi - By \cdot \sin\phi \tag{22}$$
$$By' = Bx \cdot \sin\phi + By \cdot \cos\phi \tag{23}$$

Figure 4B:
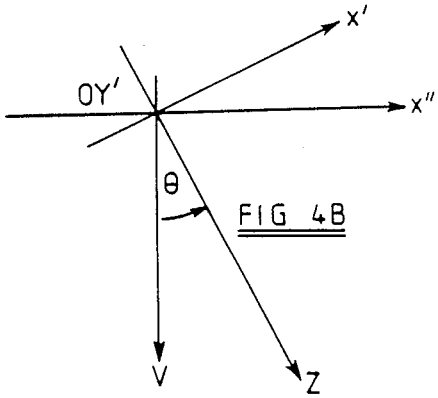

From FIG. 4B $$Bx'' = Bx' \cdot \cos\theta + Bz \cdot \sin\theta \tag{24}$$
$$Bv = -Bx' \cdot \sin\theta + Bz \cdot \cos\theta \tag{25}$$

Figure 4C:
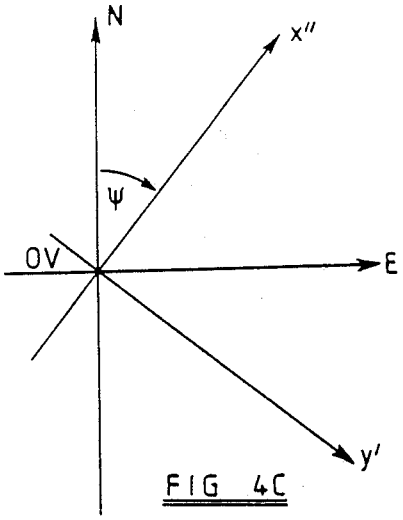

From FIG. 4C $$Bn = Bx'' \cdot \cos\psi - By' \cdot \sin\psi \tag{26}$$
$$Be = Bx'' \cdot \sin\psi + By' \cdot \cos\psi = 0 \tag{27}$$

Equations (22) to (27) yield:

$$Bn \cdot \sin\psi = -By' \tag{28}$$
$$Bn \cdot \cos\psi = Bx' \cdot \cos\theta + Bz \cdot \sin\theta \tag{29}$$
$$Bv = -Bx' \cdot \sin\theta + Bz \cdot \cos\theta \tag{30}$$
$$Bn = \{By'^2 + (Bx' \cdot \cos\theta + Bz \cdot \sin\theta)^2\}^{\frac{1}{2}} \tag{31}$$
$$Bt = (Bn^2 + Bv^2)^{\frac{1}{2}} = (Bx^2 + By^2 + Bz^2)^{\frac{1}{2}} = (Bx'^2 + By'^2 + Bz^2)^{\frac{1}{2}} \tag{32}$$

$$\tan\delta = \frac{Bv}{Bh} = \frac{-Bx' \cdot \sin\theta + Bz \cdot \cos\theta}{\{By'^2 + (Bx' \cdot \cos\theta + Bz \cdot \sin\theta)^2\}^{\frac{1}{2}}} \text{ (DIP ANGLE)} \tag{33}$$

Figure 5A:
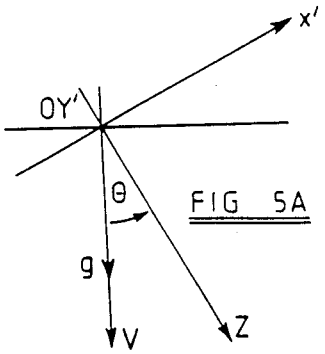
FIGS. 5A and 5B are diagrams illustrating transformation of the gravity components from the earth-fixed frame to the instrument-fixed frame.

3. Translation of $\begin{bmatrix} 0 \\ 0 \\ g \end{bmatrix}$ to $\begin{bmatrix} gx \\ gy \\ gz \end{bmatrix}$ via operators $\{\theta\}\ \{\phi\}$ From FIG. 5A $$gx' = -g \cdot \sin\theta \tag{34}$$
$$gz = g \cdot \cos\theta \tag{35}$$

Figure 5B:
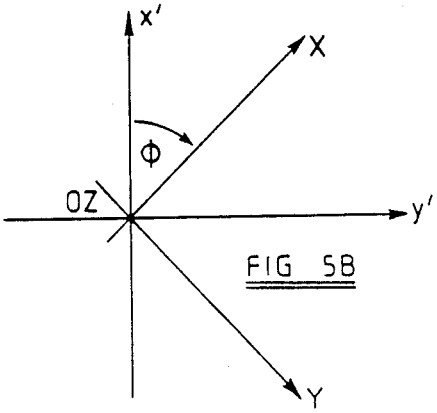

From FIG. 5B $$gx = gx' \cdot \cos\phi \tag{36}$$
$$gy = -gx' \cdot \sin\phi \tag{37}$$

Equations (34) to (37) yield:

$$\frac{\sin\theta}{\cos\theta} = \frac{(gx^2 + gy^2)^{\frac{1}{2}}}{gz} \quad (38)$$

$$\frac{\sin\phi}{\cos\phi} = \frac{gy}{-gx} \quad (39)$$

I claim:

1. A method of determining the orientation of a surveying instrument in a borehole, which method comprises:

(a) determining the inclination angle $\theta$ of the instrument in the borehole;

(b) determining the highside angle $\phi$ of the instrument in the borehole;

(c) determining two transverse components Bx and By of the local magnetic field perpendicular to the longitudinal axis of the instrument as measured at the instrument in the borehole;

(d) ascertaining the vertical component Bev of the true earth's magnetic field at the location of the borehole;

(e) determining a value $\Psi a$ for the azimuth angle of the instrument in the borehole from the expression:

$$\frac{\sin\psi a}{\cos\psi a} = \frac{-By'}{(Bx' + Bev \cdot \sin)/\cos}$$

where $Bx' = Bx \cdot \cos\phi - By \cdot \sin\phi$
and $By' = Bx \cdot \sin\phi + By \cdot \cos\phi$.

2. A method of determining the orientation of a surveying instrument in a borehole, which method comprises:

(a) determining the inclination angle $\theta$ of the instrument in the borehole;

(b) determining the highside angle $\phi$ of the instrument in the borehole;

(c) determining two transverse components Bx and By of the local magnetic field perpendicular to the longitudinal axis of the instrument as measured at the instrument in the borehole;

(d) ascertaining the horizontal component Ben of the true earth's magnetic field at the location of the borehole; and (e) determining a value $\Psi a$ for the azimuth angle of the instrument in the borehole from the expression:

$$\sin\psi a = \frac{-By'}{Ben}$$

where $By' = Bx \cdot \sin\phi + By \cdot \cos\phi$.

3. A method of determining the orientation of a surveying instrument in a borehole, which method comprises:

(a) determining the inclination angle $\theta$ of the instrument in the borehole;

(b) determining the highside angle $\phi$ of the instrument in the borehole;

(c) determining two transverse components Bx and By of the local magnetic field perpendicular to the longitudinal axis of the instrument as measured at the instrument in the borehole;

(d) ascertaining the magnitude Be of the true earth's magnetic field at the location of the borehole and the sign of the component Bez of the true earth's magnetic field along the longitudinal axis of the instrument in the borehole; and (e) determining a value $\Psi a$ for the azimuth angle of the instrument in the borehole from the sign of the component Bez along the longitudinal axis of the instrument in the borehole and the expression:

$$\frac{\sin\psi a}{\cos\psi a} = \frac{-By'}{Bx' \cdot \cos\theta + (Be^2 - Bx'^2 - By'^2)^{\frac{1}{2}} \cdot \sin\theta}$$

where $Bx' = Bx \cdot \cos\phi - By \cdot \sin\phi$ and $By' = Bx \cdot \sin\phi + By \cdot \cos\phi$.

* * * * *